US010018439B2

(12) United States Patent
Bailey

(10) Patent No.: US 10,018,439 B2
(45) Date of Patent: Jul. 10, 2018

(54) HAMMER BLOCK FOR A FIREARM

(71) Applicant: KUDZU ARMS, LLC, Hogansville, GA (US)

(72) Inventor: Christopher G. Bailey, Hogansville, GA (US)

(73) Assignee: KUDZU ARMS, LLC, Hogansville, GA (US)

( * ) Notice: Subject to any disclaimer, the term of this patent is extended or adjusted under 35 U.S.C. 154(b) by 0 days.

(21) Appl. No.: 15/138,781

(22) Filed: Apr. 26, 2016

(65) Prior Publication Data

US 2017/0307320 A1 Oct. 26, 2017

(51) Int. Cl.
*F41A 17/74* (2006.01)
*F41A 17/44* (2006.01)

(52) U.S. Cl.
CPC ..... *F41A 17/74* (2013.01); *F41A 17/44* (2013.01)

(58) Field of Classification Search
CPC . F41A 17/74; F41A 19/13–19/14; F41A 3/66; F41A 17/44
USPC ..... 42/70.08, 83
See application file for complete search history.

(56) References Cited

U.S. PATENT DOCUMENTS 37,406 A * 1/1863 Oliphant ..... F41C 9/08 42/83
109,514 A * 11/1870 Hay ..... F41A 17/74 42/70.08
608,742 A * 8/1898 Wood ..... F41C 9/08 42/83
614,019 A * 11/1898 Mattson ..... F41C 9/08 42/83
2,373,213 A * 4/1945 Williams ..... F41A 3/68 42/20
3,157,958 A * 11/1964 Lewis ..... F41A 17/74 42/66
3,762,089 A * 10/1973 Meyer, Jr. ..... F41A 17/74 42/106
4,128,042 A * 12/1978 Atchisson ..... F41A 3/26 89/138
4,412,397 A * 11/1983 Bayn ..... F41A 17/00 42/70.11
4,501,081 A * 2/1985 Izumi ..... F41A 17/44 42/70.01
4,864,760 A * 9/1989 Shivers ..... F41A 17/74 42/70.08
5,446,988 A * 9/1995 Frederick, Jr. ..... F41A 17/44 42/66
5,826,362 A * 10/1998 Lyons ..... F41A 19/16 42/66

(Continued)

*Primary Examiner* — Stephen Johnson
*Assistant Examiner* — Benjamin S Gomberg
(74) *Attorney, Agent, or Firm* — Eversheds Sutherland (US) LLP

(57) ABSTRACT

A hammer block for a firearm is disclosed. The firearm includes a firing pin and a hammer. The hammer is pivotally attached to a hammer pin within a trigger house of a lower receiver. The hammer block includes a body comprising an upper portion and a lower portion. The hammer block also includes a central gap forming two downwardly facing legs in the lower portion of the body. The body is positioned within the trigger housing in front of the hammer with the two downwardly facing legs positioned on the sides of the hammer and the central gap positioned over the hammer so that the hammer rotates into the body and is prevented from engaging the firing pin.

18 Claims, 5 Drawing Sheets

(56) References Cited

U.S. PATENT DOCUMENTS

| | | | | |
|---|---|---|---|---|
| 6,305,114 | B1 * | 10/2001 | Saltz | F41A 19/14 42/66 |
| 6,442,880 | B1 * | 9/2002 | Allan | F41A 17/066 42/66 |
| 6,647,655 | B2 * | 11/2003 | Salvitti | F41A 17/74 42/70.08 |
| 7,213,359 | B2 * | 5/2007 | Beretta | F41A 17/72 42/69.03 |
| 7,587,851 | B1 * | 9/2009 | Luth | F41A 19/00 124/31 |
| 8,196,328 | B2 * | 6/2012 | Simpkins | B25F 1/04 42/114 |
| 9,057,577 | B2 * | 6/2015 | Hannan | F41A 33/00 |
| 2015/0089854 | A1 * | 4/2015 | Findlay | F41A 19/47 42/20 |

* cited by examiner

HAMMER BLOCK FOR A FIREARM

FIELD OF THE DISCLOSURE

The disclosure generally relates to a firearm safety device and more particularly relates to a hammer block for a firearm.

BACKGROUND

The AR 15 and similar type rifles have become the top rifle being made and sold currently in the United States. So much so that many other firearms utilize the same or very similar operating mechanisms, such as sharing hammer and trigger assemblies. To increase safety in such firearms, it could be considered prudent to incorporate a specialized safety device.

Firearm safety devices are intended to eliminate or minimize the risks of death, injury, or damage caused by the improper possession, storage, or handling of firearms. One way to practice firearm safety is to employ gun locks. Typical gun locks, however, are cumbersome and make accessing the firearm quickly difficulty. Accordingly, there is a need for a firearm safety device that prevents the firearm from being discharged but can readily be removed by a user with specific knowledge of internal firearm mechanics to insure that less knowledgeable users cannot operate or discharge the firearm.

SUMMARY

Some or all of the above needs and/or problems may be addressed by certain embodiments of the hammer block disclosed herein. According to an embodiment, the firearm includes a firing pin and a hammer. The hammer is pivotally attached to a hammer pin within a trigger house of a lower receiver. The hammer block includes a body comprising an upper portion and a lower portion. The hammer block also includes a central gap forming two downwardly facing legs in the lower portion of the body. The body is positioned within the trigger housing in front of the hammer with the two downwardly facing legs positioned on the sides of the hammer and the central gap positioned over the hammer so that the hammer rotates into the body and is prevented from engaging the firing pin.

Other features and aspects of the hammer block will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
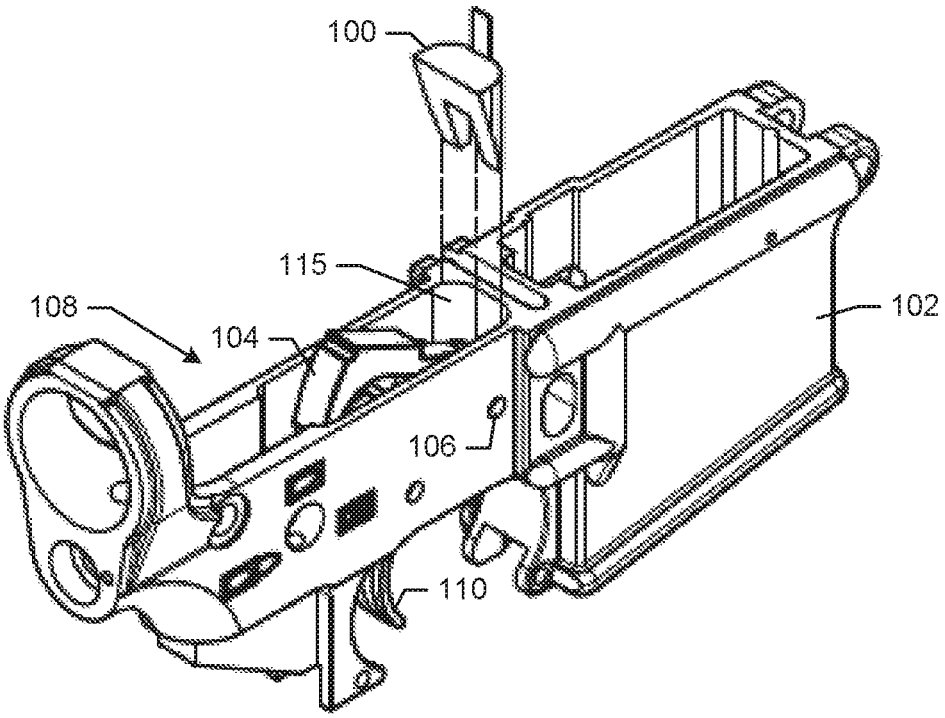
FIG. 1 depicts a hammer block positioned within a lower receiver in accordance with one or more embodiments of the disclosure.
Figure 2:
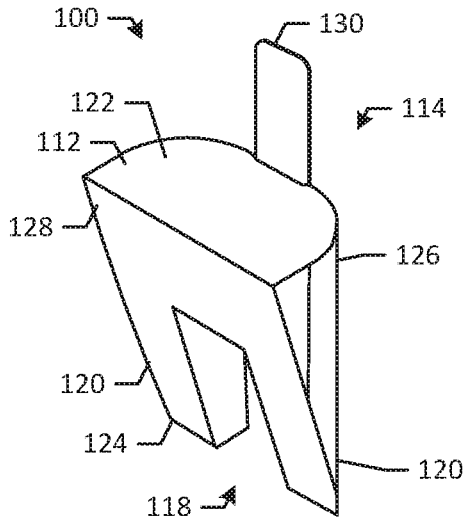
FIG. 2 depicts a hammer block in accordance with one or more embodiments of the disclosure.
Figure 3:
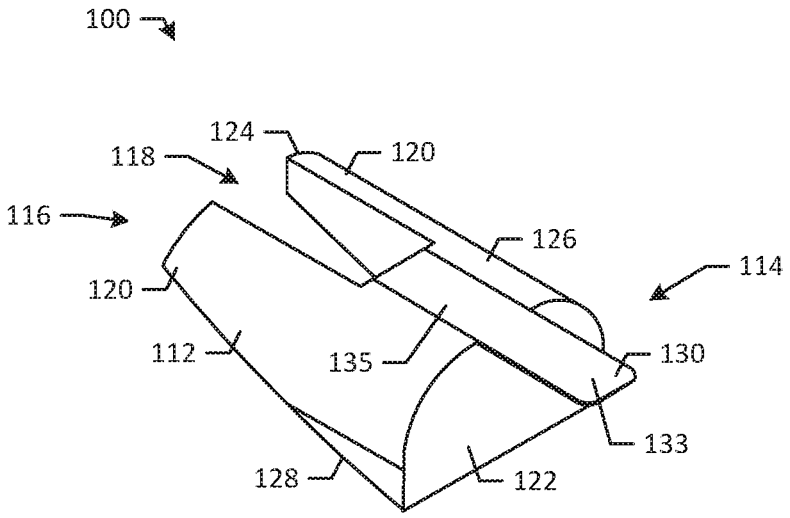
FIG. 3 depicts a hammer block in accordance with one or more embodiments of the disclosure.
Figure 4:
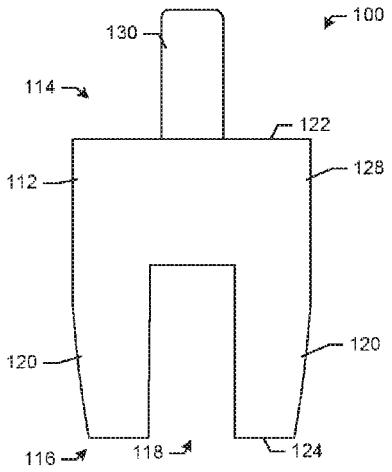
FIG. 4 depicts a hammer block in accordance with one or more embodiments of the disclosure.
Figure 5:
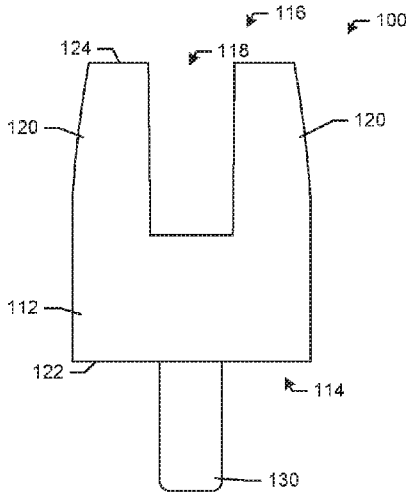
FIG. 5 depicts a hammer block in accordance with one or more embodiments of the disclosure.
Figure 6:
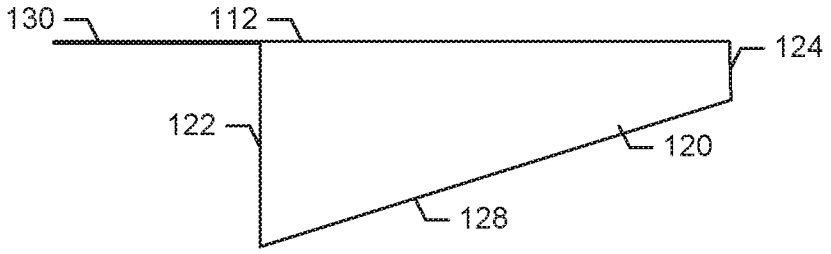
FIG. 6 depicts a hammer block in accordance with one or more embodiments of the disclosure.

Described below are embodiments of a hammer block. The hammer block is a device that is positioned in front of and around the hammer of a firearm. The hammer block prevents the hammer from engaging the firing pin, which in turn prevents the firearm from being discharged. The hammer block functions as an internal removable safety device disposed within the firearm to prevent the hammer from fully rotating to engage the firing pin. Instead, the hammer rotates into engagement with the hammer block. In this manner, the hammer block acts as an intermediate between the hammer and the firing pin.

The firearm may be a conventional firearm. For example, the firearm may be an M-16 style rifle, an AR-15 style rifle, an AR-10 style rifle, an M-4 style rifle, or any firearm that includes a hammer and trigger configuration/geometry that is similar to that of an AR, among others. The firearm includes a firing pin and a hammer. The hammer is pivotally attached to a hammer pin within a trigger house of a lower receiver. The firing pin is part of a bolt carrier group in an upper receiver. In order to insert and remove the hammer block from within the firearm, the upper and lower receivers must be pivoted to an open configuration. In this manner, the hammer block is disposed within the interior of the firearm and cannot be accessed or removed without opening the firearm.

The hammer block includes a body comprising an upper portion and a lower portion. The hammer block also includes a central gap forming two downwardly facing legs in the lower portion of the body. The body is sized and shaped to be positioned within the trigger housing in front of the hammer with the two downwardly facing legs positioned on the sides of the hammer and the central gap positioned over the hammer so that the hammer rotates into the body and is prevented from engaging the firing pin. In some instances, a pull tab extends upward from the upper portion of the body so that it can be grasped by the fingers of a user for removal.

In certain embodiments, the body is wedge shaped. For example, the body includes a greater thickness about the upper portion than the lower portion. In this manner, the two downwardly facing legs comprise a downward taper. The body also includes a front surface and a rear surface. In some instances, the front surface is substantially vertical and the rear surface is angled inward. The rear surface may include a metal surface. More so, the entire body may be formed of metal. The hammer block may comprise any material.

In some instances, the pull tab affixed to the body for removal from the firearm is made of a non-metal, flexible material, such as plastic or leather for grasping. The flexible pull tab also allows the upper receiver to be closed over the lower receiver without interference.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Turning now to the drawings, FIG. 1 depicts a hammer block 100 being positioned within a lower receiver 102 of a firearm. In this manner, the hammer block is positioned within the interior of the firearm. The hammer block acts as a safety device to prevent the firearm from being discharged. The firearm may be a conventional firearm. For example, the firearm may be an M-16 style rifle, an AR-15 style rifle, an AR-10 style rifle, an M-4 style rifle, or any firearm that includes a hammer and trigger configuration/geometry that is similar to that of an AR, among others. The firearm also may be a pistil utilizing an internal hammer with similar AR hammer and trigger geometry. The hammer block 100 can be used in conjunction with any firearm. The firearm includes a firing pin and a hammer 104. The hammer 104 is pivotally attached to a hammer pin 106 within a trigger house 108 of the lower receiver 102. The firing pin is part of a bolt carrier group in an upper receiver (not depicted), which is known in the art. The firearm may include additional or fewer components.

In operation, the hammer 104 rotates about the hammer pin 106 when the trigger 110 is pulled. The hammer 104 typically strikes the firing pin. The hammer block 100, however, acts as an intermediate to prevent the hammer 104 from striking the firing pin, which in turn prevents the firearm from being discharged. In this manner, the hammer block 100 prevents the hammer 104 from fully rotating to engage the firing pin. Instead, the hammer 104 rotates into engagement with the hammer block 100. Because the hammer block 100 is located internally within the firearm, in order to insert or remove the hammer block 100 from the firearm, the lower receiver 102 must be pivoted open from the upper receiver (not shown). In this manner, to remove the hammer block 100 from the firearm, a user must have a heightened understanding of how the firearm operates.

As depicted in FIGS. 2-6, the hammer block 100 includes a body 112. The body 112 includes an upper portion 114 and a lower portion 116. The hammer block 100 also includes a central gap 118. The central gap 118 forms two downwardly facing legs 120 in the lower portion 116 of the body 112. In some instances, the body 112 is wedge shaped. For example, the body 112 includes a greater thickness about the upper portion 114 than the lower portion 116. In this manner, the two downwardly facing legs 120 comprise a downward taper. The two downwardly facing legs 120 may be any size, shape, or configuration. The body 112 also includes a top surface 122, a bottom surface 124, a front surface 126, and a rear surface 128. In some instances, the front surface 126 is substantially vertical and the rear surface 128 is angled inward. Similarly, the top surface 122 may be substantially horizontal. The body 112 may be any size, shape, or configuration.

In certain embodiments, the hammer block 100 includes a pull tab 130. The pull tab 130 extends from the upper portion 114 of the body 112. For example, the pull tab 130 may extend from the top surface 122. The pull tab 130 may be disposed at any location about the hammer block 100. The pull tab 130 may be any size, shape, or configuration. The pull tab 130 enables a user to insert or remove the hammer block 100 from the firearm. In some instances, the pull tab 130 includes an upper portion 133 and a lower portion 135. The lower portion 135 of the pull tab 130 may be attached to the body 112, and the upper portion 133 may extend away from the body 112. The pull tab 130 may be texturized for enhanced griping ability. For example, the upper portion 133 may include a texturized surface, such as bumps, ridges, grooves, coatings, or the like.

The hammer block 100 may be metallic, ceramic, plastic, or the like. The various components and portions of the hammer block 100 may be formed of the same or different materials. For example, the rear surface 128 of the hammer block 100 may include a metal surface. In such instances, when the hammer 104 strikes the hammer block 100, a metallic "click" may be heard, which is intended to give the impression to the user that the firearm is operating properly and should discharge. This prevents users from operating the firearm that are unaware of the inclusion of the hammer block 100 internally within the firearm. In some instances, the entire body 112 may be formed of metal.

Turning back to FIG. 1, the body 112 is positioned within the trigger housing 108 in front of the hammer 104. For example, the body 112 is disposed about the hammer 104 between the hammer pin 106 and the front wall 115 of the trigger housing 108. The two downwardly facing legs 120 are positioned on the sides of the hammer 104. The central gap 118 is positioned over the hammer 104 so that the hammer 104 rotates into the rear surface 128 of the body 112. The hammer block 100 prevents the hammer 104 from engaging the firing pin.

Figure 7:
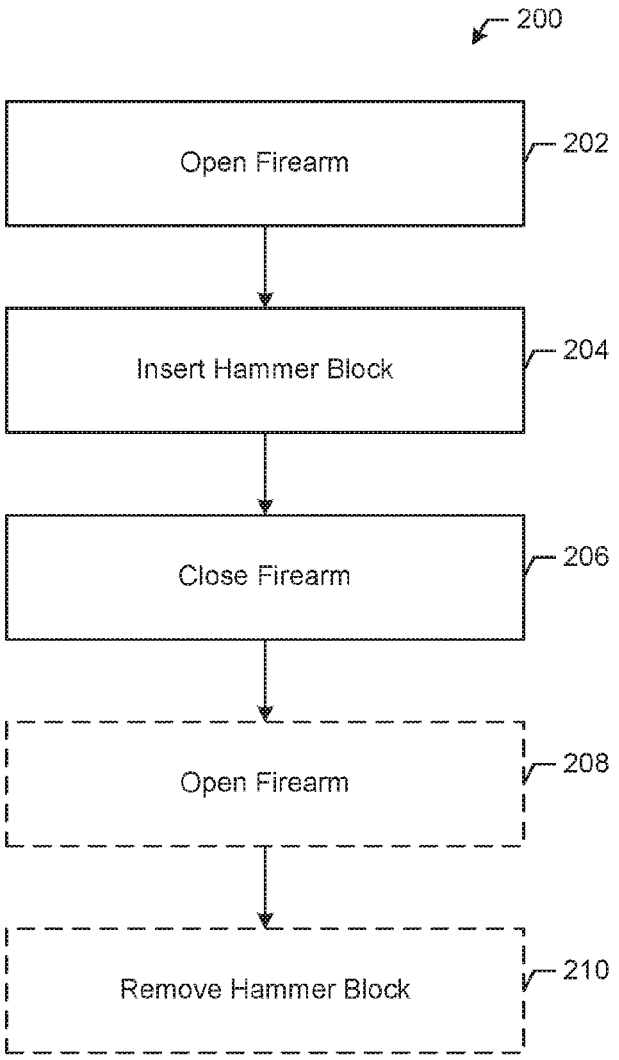
FIG. 7 is a flow diagram depicting an illustrative method for preventing the discharge of a firearm in accordance with one or more embodiments of the disclosure.

FIG. 7 is a flow diagram depicting an illustrative method 200 for preventing the discharge of a firearm in accordance with one or more embodiments of the disclosure. At block 202, the lower and upper receivers of the firearm are pivoted to an open configuration to provide access to the trigger housing of the lower receiver. At block 204, the hammer block is then inserted into the trigger housing in front of the hammer with the two downwardly facing legs positioned on the sides of the hammer and the central gap positioned over the hammer so that the hammer rotates into the body and is prevented from engaging the firing pin. The firearm is then closed at block 206. At this point, the hammer block acts as an internal safety preventing the firearm from being discharged without giving any indication to the user that the firearm is disabled. To discharge the firearm, the lower and upper receivers of the firearm are pivoted to an open configuration to provide access to the trigger housing of the lower receiver at block 208. Next, at block 210, the hammer block is removed from the trigger housing. For example, the user may pull the pull tab to remove the hammer block. The firearm may then be closed.

The steps described in blocks 202-210 of method 200 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A hammer block for a rifle having a firing pin and a hammer, wherein the hammer is pivotally attached to a hammer pin within a trigger housing of a lower receiver of the rifle, the hammer block comprising:

a body comprising an upper portion, a lower portion, a front surface, and a rear surface; and a central gap forming two downwardly facing legs in the lower portion of the body, wherein the central gap comprises a closed end and an open end forming a passage from the front surface to the rear surface between the two downwardly facing legs, wherein the body is configured to be positioned internally within the trigger housing in front of the hammer with the two downwardly facing legs positioned on respective sides of the hammer, and wherein the open end of the central gap is positioned over the hammer such that the hammer is at least partially positioned within the passage between the two downwardly facing legs so that the hammer rotates into the body and is prevented from engaging the firing pin when the trigger is intentionally pulled and the hammer is released.

2. The hammer block of claim 1, further comprising a flexible pull tab extending upward from the upper portion of the body.

3. The hammer block of claim 1, wherein the body is wedge shaped.

4. The hammer block of claim 3, wherein the body comprises a greater thickness about the upper portion than the lower portion.

5. The hammer block of claim 1, wherein the two downwardly facing legs comprise a downward taper.

6. The hammer block of claim 1, wherein the front surface is substantially vertical and the rear surface is angled inward.

7. The hammer block of claim 6, wherein the rear surface comprises a metal surface.

8. The hammer block of claim 1, wherein the body is formed of metal.

9. A hammer block for a rifle having a firing pin and a hammer, wherein the hammer is pivotally attached to a hammer pin within a trigger housing of a lower receiver of the rifle, the hammer block comprising:

a wedge shaped body comprising an upper portion, a lower portion, a front surface, and a rear surface;

a central gap forming two downwardly facing legs in the lower portion of the wedge shaped body; and a pull tab extending upward from the upper portion of the wedge shaped body, wherein the central gap comprises a U-shaped channel forming a passage from the front surface to the rear surface between the two downwardly facing legs, wherein the wedge shaped body is configured to be positioned internally within the trigger housing in front of the hammer with the two downwardly facing legs positioned on respective sides of the hammer, wherein the U-shaped channel of the central gap is positioned over the hammer such that the hammer is at least partially positioned within the passage between the two downwardly facing legs so that the hammer rotates into the wedge shaped body and is prevented from engaging the firing pin when the trigger is intentionally pulled and the hammer is released, and wherein the hammer block is positionable within the rifle so as to be accessible for removal only by pivoting open the lower receiver about an upper receiver to expose an interior of the rifle.

10. The hammer block of claim 9, wherein the wedge shaped body comprises a greater thickness about the upper portion than the lower portion.

11. The hammer block of claim 9, wherein the two downwardly facing legs comprise a downward taper.

12. The hammer block of claim 9, wherein the front surface is substantially vertical and the rear surface is angled inward.

13. The hammer block of claim 12, wherein the rear surface comprises a metal surface.

14. The hammer block of claim 9, wherein the wedge shaped body is formed of metal.

15. A method of preventing a discharge of a rifle having a firing pin and a hammer, wherein the hammer is pivotally attached to a hammer pin within a trigger housing of a lower receiver of the rifle, the method comprising:

providing a hammer block comprising:

a body comprising an upper portion, a lower portion, a front surface, and a rear surface, and a central gap forming two downwardly facing legs in the lower portion of the body, wherein the central gap comprises a closed end and an open end forming a passage from the front surface to the rear surface between the two downwardly facing legs; and positioning the body internally within the trigger housing in front of the hammer with the two downwardly facing legs positioned on respective sides of the hammer such that the open end of the central gap is positioned over the hammer such that the hammer is at least partially positioned within the passage between the two downwardly facing legs so that the hammer rotates into the body and is prevented from engaging the firing pin when the trigger is intentionally pulled and the hammer is released.

16. The method of claim 15, further comprising removing the body with a pull tab extending upward from the upper portion of the body.

17. The method of claim 15, wherein the body is wedge shaped.

18. The method of claim 17, wherein the body comprises a greater thickness about the upper portion than the lower portion.

* * * * *